United States Patent [19]

O'Brien

[11] 4,378,653

[45] Apr. 5, 1983

[54] AERODYNAMIC TOY

[76] Inventor: Bernard O'Brien, 64D Beacon Village, Burlington, Mass. 01803

[21] Appl. No.: 303,764

[22] Filed: Sep. 21, 1981

[51] Int. Cl.[3] ..... A63H 27/00

[52] U.S. Cl. ..... 46/74 D; 273/58 R

[58] Field of Search ..... 46/74 D, 74 R; 273/424, 273/428, 26 R, 58 R, 58 A, 58 B, 58 J, 425, 128 R, 58 K; D21/82, 85, 86, 92

[56] References Cited

U.S. PATENT DOCUMENTS

| | | | |
|---|---|---|---|
| 1,292,011 | 1/1919 | Monroe | 273/424 |
| 3,416,800 | 12/1968 | Randall | 273/26 R X |
| 3,801,103 | 4/1974 | Mazuela | 273/128 R |
| 3,900,986 | 8/1975 | Torres | 46/74 D |
| 3,930,650 | 1/1976 | Watson | 273/424 |
| 4,184,682 | 1/1980 | Collins et al. | 273/58 R X |

*Primary Examiner*—Mickey Yu

*Attorney, Agent, or Firm*—Wolf, Greenfield & Sacks

[57] ABSTRACT

An aerodynamic toy adapted to be thrown through the air having a dish shaped body which is substantially hemispherical in shape and which has a rim integral with the body that provides balance and stability when the toy is thrown. The rim has upper and lower parallel surfaces that are substantially perpendicular to the axis of the body and a frusto-conical outer surface. The toy is sized to be grasped with the index finger and thumb extending about the body adjacent the rim in opposite directions and with the middle finger lying against the bottom of the rim.

4 Claims, 3 Drawing Figures

AERODYNAMIC TOY

INTRODUCTION

The present invention relates to an aerodynamic toy and more particularly comprises a new and improved generally hemispherical shaped toy that is thrown like a ball and which can be made to curve, drop, rise, etc., in a more pronounced manner than a conventional full sphere ball.

In recent years a number of toys employing aerodynamic principles have been developed, such as Frisbees, and these toys have proved to be extremely popular. The present invention in a sense is influenced by the popular aerodynamic toys, but the toy itself is designed to be used in games that are variations of baseball, such as stick ball. While the toy is capable of being made to change direction more sharply than a conventional ball, its design is such that the toy may be thrown with precision and the course of its flight may be predicted and repeated. Thus, it may be controlled with much greater precision than the so-called Frisbee toys, and it can be thrown much faster than those toys.

One important object of this invention is to provide an aerodynamic toy that can be thrown like a ball and perform "tricks" such as curves, drops, rises, etc., with repeatability and predictability.

Another object of this invention is to provide an aerodynamic toy that is inexpensive to manufacture and can withstand repeated blows and maintain its shape so that it can have an extended useful life.

To accomplish these and other objects, the aerodynamic toy of this invention is provided with a substantially hemispherically-shaped body with an enlarged rim that provides balance for the toy while in flight. The toy is sized to be grasped between the index finger and the thumb which encircle the body at its largest diameter just above the rim and with the middle finger underlying the rim for support and stability.

These and other objects and features of the invention will be better understood and appreciated from the following detailed description of one embodiment thereof, selected for purposes of illustration and shown in the accompanying drawing.

DETAILED DESCRIPTION OF THE DRAWINGS

Figure 1:
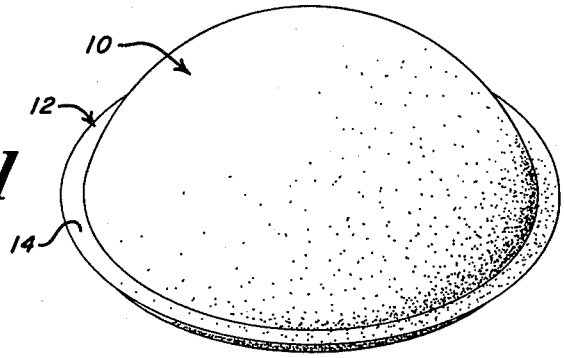
FIG. 1 is a perspective view of the aerodynamic toy of this invention.
Figure 2:
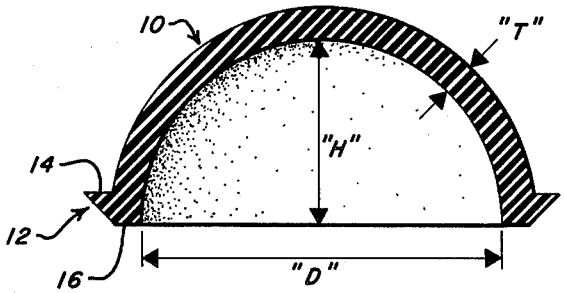
FIG. 2 is a vertical section through the center of the toy.
Figure 3:
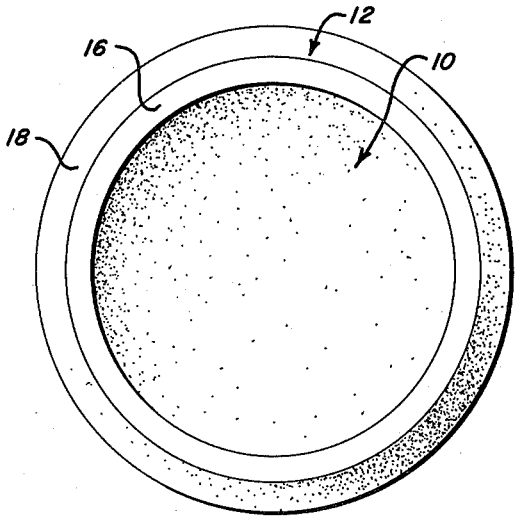
FIG. 3 is a bottom plan view of the toy.

The toy shown in the drawings is a relatively simple structure essentially composed of a main body 10 and a rim 12. The body and rim are integrally formed by conventional molding techniques and are made of rubber or a rubber-like material such as PVC. The material used is not critical except that it should have sufficient strength and resiliency to be able to withstand repeated blows such as those imposed by a bat without permanently distorting.

The body 10 preferably has a thickness "T" of approximately $\frac{1}{8}$ inch, and the thickness is uniform throughout. The diameter "D" of the toy measured from the inner edge of the rim is approximately $2\frac{1}{2}$ inches, and the height "H" of the body measured from the plane of the outer edge of the rim to the inner surface of the body along the body axis is approximately 1 inch.

The rim structure 12 provided to balance the toy during flight is defined by upper and lower surfaces 14 and 16 that are substantially parallel to one another and are perpendicular to the axis of the body. The outer surface 18 of the rim is frusto conical in shape with its smaller diameter at the lower surface 16.

As indicated above, the toy is designed to be thrown like a ball. The diameter of the toy enables it to be grasped between the index finger and thumb, each lying immediately above the rim and extending in opposite directions about the circumference, and with the middle finger of the throwing hand lying under the rim against the surface 16. The toy may be thrown overhand, side arm or underhand, depending on the technique of the player, with very substantial accuracy and for a distance of thirty or forty feet or more, and depending upon the speed of rotation and the twist imparted to the toy as it is thrown, it may be made to rise, drop or curve-like, etc., but in a more pronounced fashion than a conventional ball.

In the preferred form, surface 14 is approximately $\frac{1}{8}$ inch wide, surface 16 is approximately 3/16 inch wide, and frusto conical surface 18 is approximately 5/16 inch wide. Thus the thickness of the rim at the point where it joins the body is approximately twice that of the body. Depending upon the density of the material from which the toy is molded, the wall thickness of the body may be up to approximately $\frac{3}{8}$ inch, and the height "H" of the body may be 1 inch $\pm\frac{1}{4}$ inch. Furthermore, while the angle of the frusto conical surface 18 with respect to surface 16 is preferably 45 degrees, that angle may vary from 30 to 60 degrees. The various dimensions given for the toy, while preferred, are not to be construed as limitations of the invention.

Having described the invention in detail, those skilled in the art will appreciate that modifications may be made thereof without departing from its spirit. Therefore, it is not intended that the scope of this invention be limited to the specific embodiment illustrated and described. Rather, it is intended that the scope of the invention be determined by the appended claims and their equivalents.

What is claimed is:

1. An aerodynamic toy adapted to be thrown through the air comprising:

a substantially hemispherically shaped body formed of a strong and resilient material and having a substantially hemispherically shaped cavity disposed therein, said body having an axis extending normally from a plane defined by a base of said body, said cavity progressively increasing in cross sectional area toward said base; and a solid rim disposed around the outer surface of said body closely adjacent said base and projecting outwardly away from the outer surface of said body, said rim having an upper surface spaced from said base and extending generally normally to said axis of said body and an outer frusto-conically shaped wall extending from said upper surface inwardly and downwardly toward said base, said rim reinforcing said body adjacent said base and providing aerodynamic balance to said toy during flight.

2. An aerodynamic toy as defined in claim 1 further characterized by said cavity having a diameter of approximately $2\frac{1}{2}$ inches immediately adjacent the rim to enable the toy to be held with the thumb and index fingers extending around the body in opposite directions and with the middle finger engaging the bottom of the rim so that the toy can be thrown like a ball.

3. An aerodynamic toy as defined in claim 2 further characterized by said body having a wall thickness of approximately $\frac{1}{8}$ inch and said frusto-conical wall flaring outwardly at approximately 45° from the axis.

4. An aerodynamic toy as defined in claim 1 further characterized by said upper surface of said rim having an average radial extent measured from the outer wall of the body which is substantially equal to the wall thickness of the body.

* * * * *